US008852017B2

(12) United States Patent
Zambrello

(10) Patent No.: US 8,852,017 B2
(45) Date of Patent: Oct. 7, 2014

(54) GOLF SAND BUNKER SIMULATOR

(71) Applicant: Matthew Zambrello, Avon, CT (US)

(72) Inventor: Matthew Zambrello, Avon, CT (US)

( * ) Notice: Subject to any disclaimer, the term of this patent is extended or adjusted under 35 U.S.C. 154(b) by 0 days.

(21) Appl. No.: 13/873,944

(22) Filed: Apr. 30, 2013

(65) Prior Publication Data

US 2013/0267341 A1 Oct. 10, 2013

(51) Int. Cl.
*A63B 69/36* (2006.01)

(52) U.S. Cl.
CPC ..... *A63B 69/3661* (2013.01); *A63B 2209/00* (2013.01)
USPC ..... 473/278; 473/279

(58) Field of Classification Search
CPC ..... A63B 69/3661
USPC ..... 473/150, 157, 278, 279
See application file for complete search history.

(56) References Cited

U.S. PATENT DOCUMENTS

| | | | | |
|---|---|---|---|---|
| 4,535,989 | A * | 8/1985 | Lovin | 473/158 |
| 4,630,828 | A | 12/1986 | Lovin | |
| 4,928,966 | A | 5/1990 | Miller | |
| 5,720,670 | A | 2/1998 | Oxley et al. | |
| 5,803,820 | A | 9/1998 | McCarty | |
| 5,885,168 | A | 3/1999 | Bair | |
| 6,139,443 | A | 10/2000 | Reynolds | |
| 6,902,494 | B1 | 6/2005 | Frishberg | |
| 2006/0046862 | A1 * | 3/2006 | Campbell | 473/168 |

FOREIGN PATENT DOCUMENTS

| | | | |
|---|---|---|---|
| CN | 102587029 A | * | 7/2012 |
| JP | 2001145549 A | * | 5/2001 |

* cited by examiner

*Primary Examiner* — Nini Legesse
(74) *Attorney, Agent, or Firm* — UConn IP Law Clinic; Susan K. Pocchiari; Raymond Withers-Tong

(57) ABSTRACT

A golf sand bunker simulator which mimics the feel of sand by using beaded chains that are attached to a mat. The golf sand bunker simulator creates a sand-like experience which can assist a golfer to develop their sand shot technique. The golf sand bunker simulator is portable and because it does not generate dust or debris provides a clean golf training experience for both indoor and outdoor practice. The golf sand bunker simulator can also have a grass turf attached to enable a golfer to practice both sand and grass shots.

18 Claims, 4 Drawing Sheets

GOLF SAND BUNKER SIMULATOR

TECHNICAL FIELD

The present invention is generally directed to a golf sand bunker simulator. More particularly, the present invention is directed to a golf sand bunker simulator that is portable and that a golfer can use to practice golf techniques for sand shots without creating or leaving behind dust and debris.

BACKGROUND OF THE INVENTION

Golf shots played out of a sand bunker generally instill anxiety in golfers, especially less advanced golfers. Part of the anxiety associated with golf sand bunker shots is that golfers do not adequately practice those shots because generally golf practice takes place at the driving range. The practice surface at a driving range is generally flat and does not resemble the sand bunker terrain and the conditions encountered during play.

It is desirable that a practice surface simulate sand bunker conditions which are encountered during play. It is further desirable that the golfer not rely on manipulating real sand nor create the dust and debris that real sand produces. It is also desirable that a golfer can practice both his stroke and stance in the uphill, downhill or side hill position. The practice surface should be adaptable to simulate various sand bunker shots without changing locations.

To facilitate practice, it is desirable that a golf sand shot simulator be very easy to use, clean, safe and very versatile.

From the above, it is therefore seen that there exists a need in the art to overcome the deficiencies and limitations described herein and above.

SUMMARY OF THE INVENTION

The shortcomings of the prior art are overcome and additional advantages are provided through the use of a golf practice mat which includes a mat having a plurality of perforations with a multitude of beaded chains threaded through the perforations to form a loose layer of beads on the exposed surface of the mat, wherein the beaded chains are comprised of beads attached to a chain.

Additional features and advantages are realized through the techniques of the present invention. Other embodiments and aspects of the invention are described in detail herein and are considered a part of the claimed invention.

The recitation herein of desirable embodiments is not meant to imply or suggest that any or all of these embodiments are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

The present invention pertains to a golf practice mat which can be used to practice golf sand bunker shots. The golf practice mat is perforated and beaded chains are threaded through the perforations. The beaded chains are tightly strung around the bottom of the mat and the bulk of the beads lie loosely on the top surface of the mat. By lying loosely on the top surface of the mat, the beaded chains simulate sand-like conditions. The beads can be hand manipulated to create an uphill, downhill and side hill playing surface.

A golf ball can then be placed at the desired angle on top of the beaded chains. A golfer can then proceed to practice his golf swing according to the desired angle. Once the golf ball is struck, the beaded chains may scatter, however, unlike sand, no debris is created and the golfer can readjust the beads to recreate the desired angle.

Figure 1:
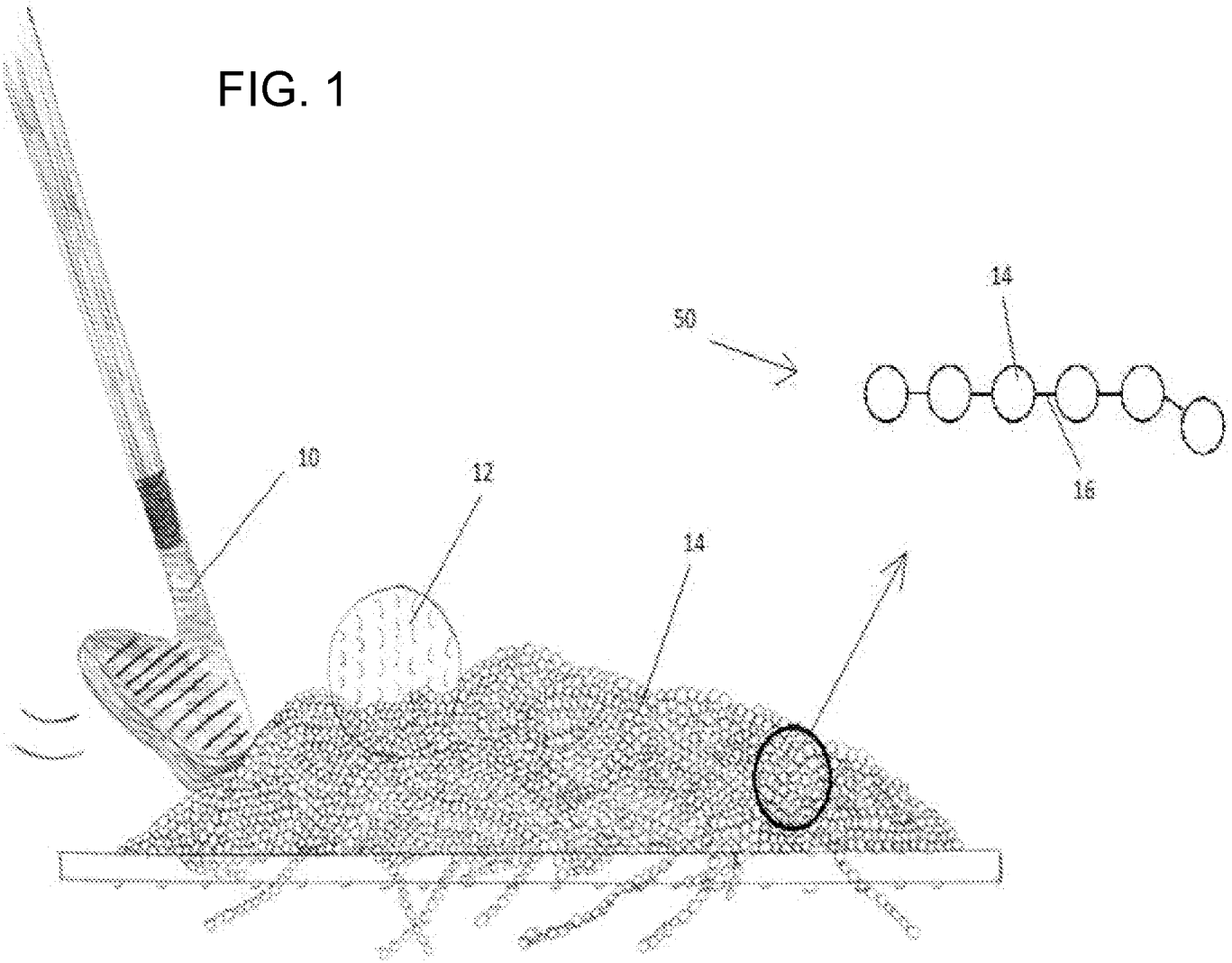
FIG. 1 illustrates an embodiment of the golf sand bunker simulator showing the golf ball on top of the beaded chains prior to being struck by the golf club.
Figure 2:
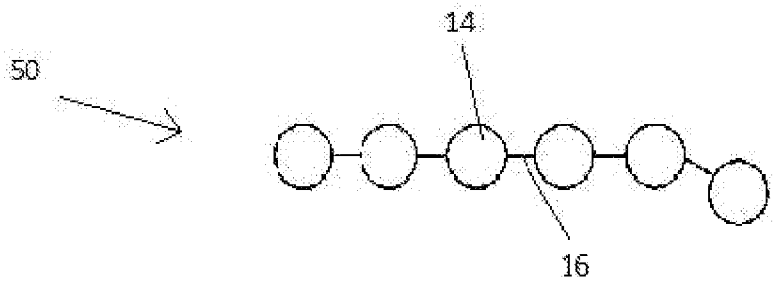
FIG. 2 illustrates a beaded chain with beads placed at various intervals along the chain.

Referring to FIG. 1 and FIG. 2, a multitude of beaded chains 50, sit loosely on top of a mat 18. The beaded chains can be manipulated by the golfer to provide the desired angle for the golf stroke. A golf ball 12 is placed at the desired angle. A golfer can then strike the ball with a golf club 10. After the golf ball is struck, the beaded chains 50 do not entangle and can scatter, but do not scatter far because they are attached to the bottom of the mat. A golfer can easily reconstitute the general angle of the striking surface and repeat the golf practice exercise. The feel generated by the loosely agglomerated beaded chains 50 is similar to that of real sand, but unlike real sand, this invention provides a cleaner experience for practicing golf sand bunker techniques because the dust and debris that is normally associated with playing in real sand is not generated. Since this device produces no dust or debris it can be used both indoors and outdoors. In addition, the mat can rest on a base made from wood, foam, rubber or any other suitable material.

Referring to FIG. 2, a beaded chain 50 comprises the beads 14 and chain 16. The chain is flexible and kink-resistant. The beads 14 can be comprised of metallic or non-metallic materials. Materials that can be used for the beads 14 include metallic beads, plastic beads, porcelain beads, glass beads, ceramic beads and acrylic beads. The chain material 16 can be comprised of metallic and non-metallic material. Materials that can be used for the chain 16 include brass or nickel plated steel, dipped and polished yellow brass, dipped and polished Rich Low brass, and nickel plated brass. Both the bead surface and the chain surface can be polished or unpolished and both surfaces can have various types of finishes.

The beads 14 come in various sizes diameters and can range from 0.072 inch to ⅝inch.

In one embodiment, the bead diameter is ⅛inch, and there are six beads per inch of chain, or one ⅛inch bead every 0.042 inches.

Figure 3:
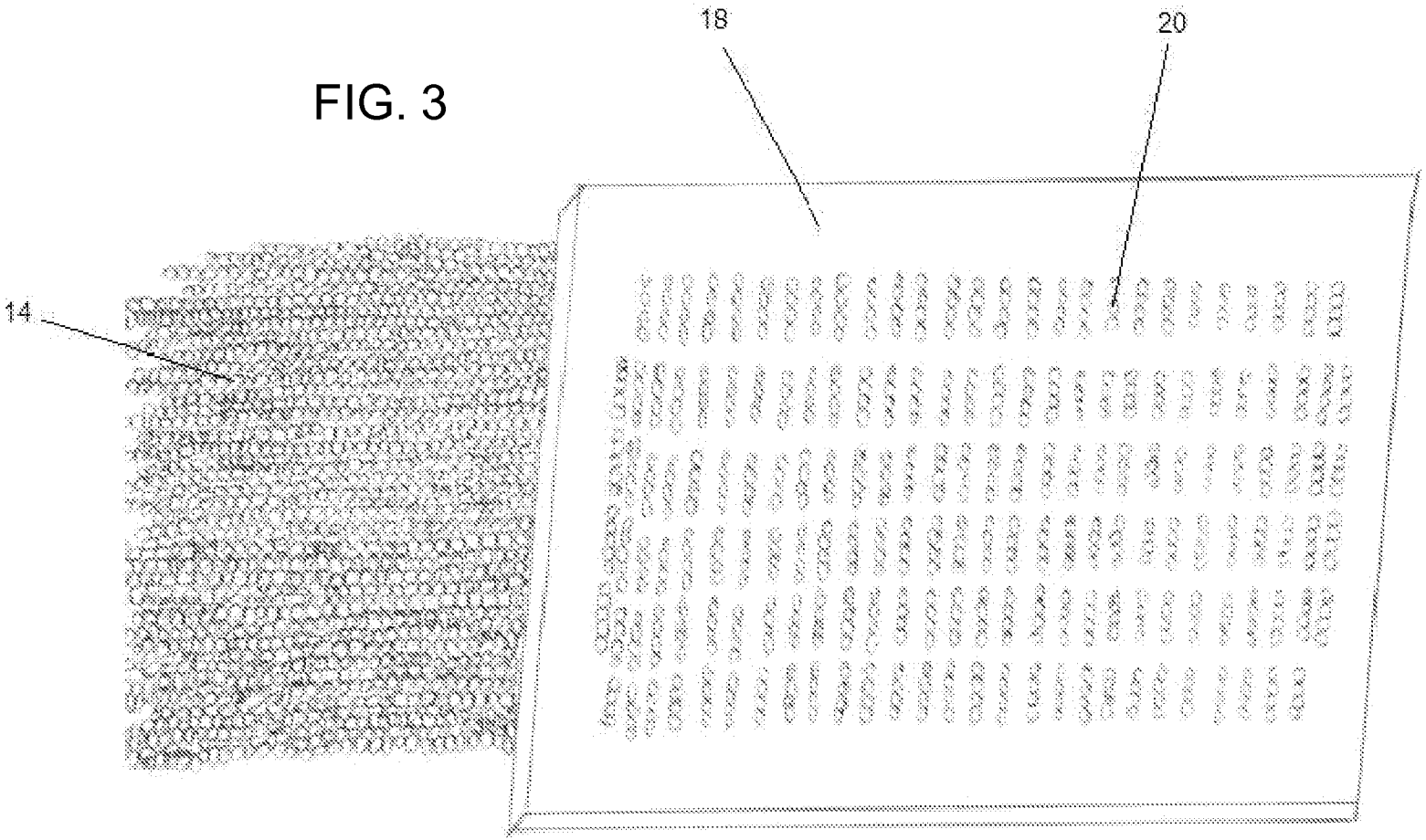
FIG. 3 illustrates the beads threaded through the underside of the mat.

Referring to FIG. 3, the underside of the mat 18 is shown. The underside of the mat is the side that faces the ground. A beaded chain 50 is threaded through the mat perforations 20 and is tightly threaded on the underside so as to have the maximum amount of string facing the exposed upper surface. The exposed surface is the surface that does not face the ground. The tight threading of the beaded chain 50 on the underside of the mat 18 avoids unevenness on the underside of the mat. Alternatively, the beaded chain 50 can be knotted on the underside of the patent.

Figure 4:
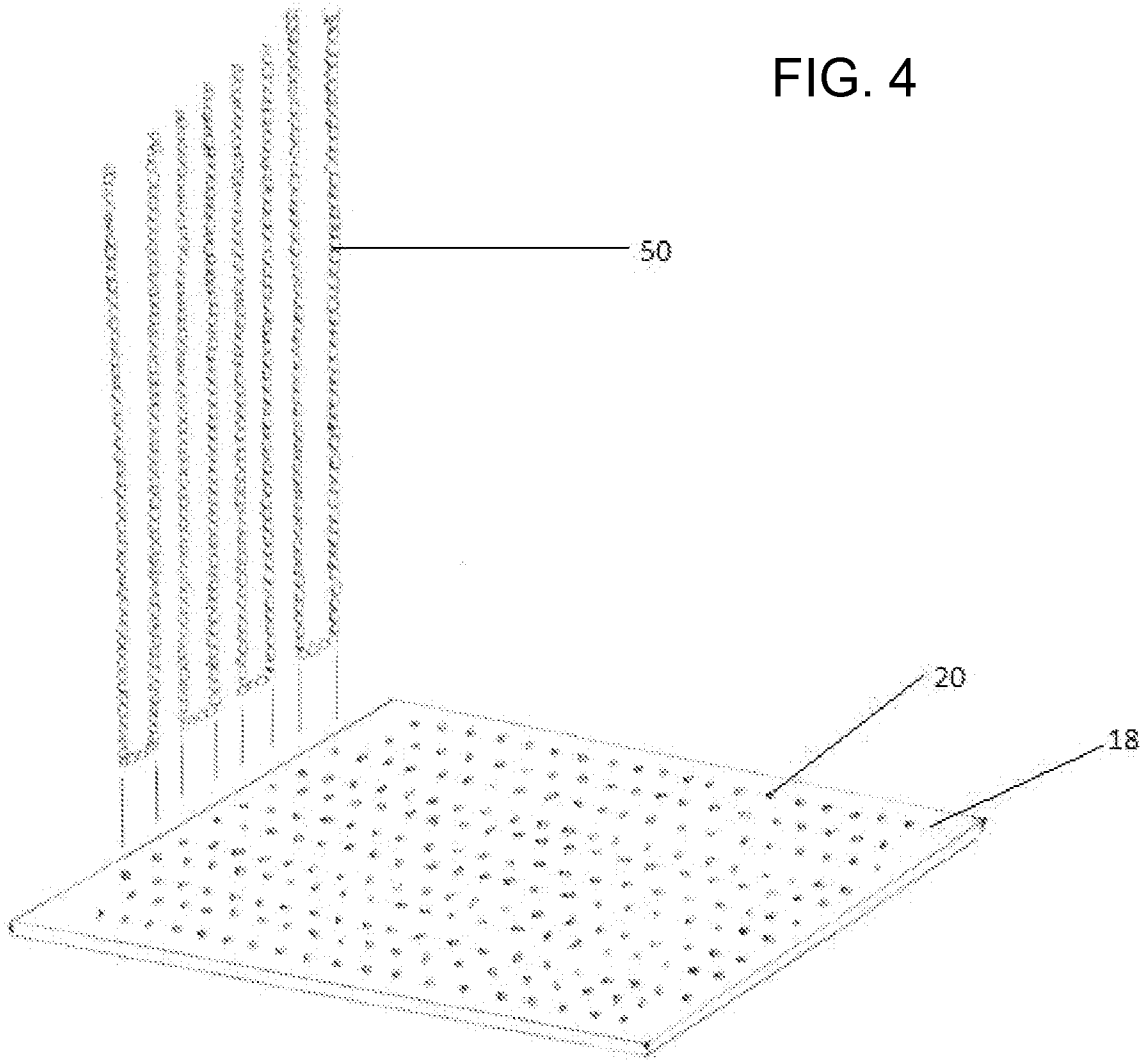
FIG. 4 illustrates the perforations in the mat and the threaded of the beaded chains in adjacent perforations.

Referring to FIG. 4, the perforations 20 on the mat 18 are shown. The beaded chain 50 is threaded through each adjacent pair of perforations. Once all the beaded chains are threaded through the mat, the bulk of the beaded chains is laid to rest on the exposed upper surface of the mat.

Referring to FIG. 3, the underside of the mat 18 is shown. The underside of the mat is the side that faces the ground. A beaded chain 50 is threaded through the mat perforations 20 and is tightly threaded on the underside so as to have the maximum amount of string facing the exposed upper surface. The exposed surface is the surface that does not face the ground. The tight threading of the beaded chain 50 on the underside of the mat 18 avoids unevenness on the underside of the mat. Alternatively, the beaded chain 50 can be knotted on the underside of the mat.

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. A golf practice mat comprising:

a mat;

a multitude of beaded chains attached to the mat to form a loose layer of beads on an exposed surface of the mat, wherein the beaded chains are comprised of beads attached to a chain, and wherein the beaded chains simulate golf sand bunker conditions.

2. The golf practice mat of claim 1 wherein the bead material is comprised of metallic or non-metallic materials or any combination thereof.

3. The golf practice mat of claim 2 wherein the non-metallic materials are comprised of plastic beads, porcelain beads, glass beads, ceramic beads and acrylic beads.

4. The golf practice mat of claim 2 wherein a diameter of a bead ranges from about 0.072 inches to about ⅝ of an inch.

5. The golf practice mat of claim 1 wherein the chain material is comprised of metallic or non-metallic materials or any combination thereof.

6. The golf practice mat of claim 5 wherein the chain material is comprised of brass or nickel plated steel, or dipped and polished yellow brass, or dipped and polished Rich Low brass, or nickel plated brass.

7. The golf practice mat of claim 1 wherein a space between the beads on the beaded chain ranges from about 0 to about 1 inch.

8. The golf practice mat of claim 1 wherein a surface of a bead is polished or unpolished.

9. The golf practice mat of claim 1 wherein a chain surface is polished or unpolished.

10. The golf practice mat of claim 1 wherein the bead surface a surface of a bead has a wavy finish.

11. The golf practice mat of claim 1 wherein a chain surface has a wavy finish.

12. A golf practice mat comprising:

a mat, wherein the matt is attached to grass turf;

a multitude of beaded chains attached to the mat to form a loose layer of beads on an exposed surface of the mat, wherein the beaded chains are comprised of beads attached to a chain.

13. The golf practice mat of claim 12 wherein the bead material is comprised of metallic or non-metallic materials or any combination thereof.

14. The golf practice mat of claim 13 wherein the non-metallic materials are comprised of plastic beads, porcelain beads, glass beads, ceramic beads and acrylic beads.

15. The golf practice mat of claim 13 wherein a diameter of a bead ranges from about 0.072 inches to about ⅝ of an inch.

16. The golf practice mat of claim 12 wherein the chain material is comprised of metallic or non-metallic materials or any combination thereof.

17. The golf practice mat of claim 12 wherein a space between the beads on the beaded chain ranges from about 0 to about 1 inch.

18. A golf practice mat comprising:

a mat having a perforation;

a multitude of beaded chains attached to the mat through the perforation to form a loose layer of beads on an exposed surface of the mat, wherein the beaded chains are comprised of beads attached to a chain, and wherein the beaded chains simulate golf sand bunker conditions.

* * * * *